US005101603A

United States Patent [19]

Sevilla

[11] Patent Number: 5,101,603

[45] Date of Patent: Apr. 7, 1992

[54] SURFACE TREATMENT METHOD FOR FINISHING MATERIALS CAPABLE OF BEING POLISHED

[76] Inventor: Joseph Sevilla, Peyregude, 19360 Malemort, France

[21] Appl. No.: 292,158

[22] Filed: Dec. 30, 1988

[51] Int. Cl.[5] ..... B24B 1/00

[52] U.S. Cl. ..... 51/310; 51/311; 51/283 R

[58] Field of Search ..... 51/310, 311, 283 R; 428/187, 932, 30; 40/453

[56] References Cited

U.S. PATENT DOCUMENTS

| | | | |
|---|---|---|---|
| 734,135 | 7/1903 | Porter | 428/30 |
| 1,354,471 | 10/1920 | Doner | 40/453 |
| 1,431,917 | 10/1922 | Antaramian . | |
| 2,875,543 | 3/1959 | Sylvester et al. . | |

FOREIGN PATENT DOCUMENTS 487 of 1910 United Kingdom .

*Primary Examiner*—Bruce M. Kisliuk
*Assistant Examiner*—Jack Lavinder
*Attorney, Agent, or Firm*—Griffin, Branigan & Butler

[57] ABSTRACT

In order to polish a zone (9) of a surface (2) so as to leave visible marks, the zones of the surface which are not being worked on are covered by a mask (4) having an adhesive face and a face covered with an abrasion-resistant metal layer (7) with the total thickness (e) of the mask not exceeding 40 μm so that the non-polished margin along the edge (8) of the mask (4) has a width (l) of less than about 0.1 mm, thereby making it invisible to the naked eye so that adjacent zones appear to come directly into contact without a visible separating margin.

6 Claims, 2 Drawing Sheets

ℓ (mm)
1,2
1,1
1
0,9
0,8
0,7
0,6
0,5
0,4
0,3
0,2
0,1
0
25μ 30μ 40μ 50μ 55μ 60μ 70μ 75μ 80μ 90μ 100μ
EPAISSEUR (μm)

ℓ (mm)
1,1
1
0,9
0,8
0,7
0,6
0,5
0,4
0,3
0,2
0,1
0
25μ 30μ 40μ 50μ 55 60μ 70μ 75 80μ 90μ 100μ
EPAISSEUR (μm)

SURFACE TREATMENT METHOD FOR FINISHING MATERIALS CAPABLE OF BEING POLISHED

The invention relates to a surface treatment method for finishing materials capable of being polished.

The term "polished" is used herein to designate operations whereby the surface of a material is worked by means of abrasive powders or tools which leave marks on said surface.

BACKGROUND OF THE INVENTION

The use of finer and finer abrasive powders for polishing a surface has been known for a long time. The first mirrors were made in this way on easily-polished metal surfaces such as copper, for example. However, the purpose of such "mirror quality" polishing is for the polishing abrasive or tool used to leave no marks that are visible to the naked eye.

Conversely, it is also known that a surface may be polished less thoroughly by deliberately leaving polish marks thereon, either to hide a surface state or a geometrical state which is not entirely satisfactory, or else simply as a technical method for achieving a decorative pattern.

The invention lies in the technical field that may be referred to as the field of polishing to leave visible marks. In the past, polishing of this type has been classified in two different categories:

the category of polishing to leave parallel rectilinear marks all extending in the same direction over an entire polished surface; and the category of polishing to leave circular marks in the form of numerous partially overlapping circles that together cover the entire polished surface.

The main object of the invention is to provide a method of polishing that leaves visible marks on a surface on which determined polished zones of arbitrary size and configuration appear, with said zones being immediately adjacent to one another, and in which the visible marks have at least one general determined direction in each zone but have general directions which are clearly different between adjacent zones, said zones either having no visible separating margins between them, or else having a visible separating margin of predetermined width between adjacent zones.

The invention also extends to any surface which is polished with visible polishing marks and on which there exists zones that have been polished in different general directions without there being perceptible separating margins between adjacent zones.

SUMMARY OF THE INVENTION

Prior to performing an operation of polishing to leave visible marks on different adjacent limited zones of a surface of larger size than the size of each of said zones and having an initial state, said surface is covered, according to a first aspect of the present invention, outside a first zone thereof by means of a mask having a thickness of not more than 40 μm, said mask being caused to adhere to the surface by any appropriate means, said first zone being polished in such a manner as to cause visible marks having a first general direction to appear therein, the mask being removed, said already-polished first zone being covered together with a portion of the remainder of the surface in the same manner by means of a mask leaving bare a second zone to be polished adjacent to the first zone, said second zone being polished in such a manner as to cause visible marks having a second general direction to appear therein, and so on, with the process being repeated as many times as desired in order to obtain polished zones on said surface having visible marks in different general directions with no perceptible separating margin being visible between the zones.

The thickness of 40 μm for the mask that is used is a critical value above which separating margins start showing up between adjacent zones having differentially oriented visible marks. Such margins are very narrow areas where the polished surface retains its initial state. The thicker the mask beyond 40 μm, the wider and more visible the separating margin.

Polishing to leave parallel visible marks is performed in a single operation, sometimes called "brushing", in which use is made of a mechanical support and an abrasive capable of scratching the surface being worked. During polishing, the mask is subjected to the action of the abrasive in the same way as the surface being worked. It is therefore necessary to use a mask which withstands abrasion, at least for the duration of the polishing operation. A mask thickness of less than 40 μm may be selected so long as the substance from which the mask is made is strong enough.

A thin metal foil, having a thickness of 30 μm to 40 μm, for example, may be used to make a mask in accordance with the invention. If the metal is tempered steel and if the material whose surface is worked is magnetizable, as are certain grades of stainless steel, then the mask can be held in place on a zone to be protected by magnetic attraction passing through the material being worked.

In general, it is preferable to use an adhesive for holding the mask on the portion of the surface which is to be protected. Thin foils are commercially available made of various different materials (metal or metal-coated materials or plastic materials) which are provided with a layer of adhesive on one face. Such foils are suitable for implementing the method of the invention. In a variant, one of the surfaces of a mask may be directly covered with an adhesive of sufficient strength (e.g. of the cyanoacrylate type). It should be observed that the above-mentioned thickness includes a portion constituted by the thickness of the adhesive layer.

Other equivalent means may be used to hold the mask on the surface to be protected. When the workpiece is porous (e.g. having a multitude of small holes passing therethrough), the mask may be held thereon by establishing sufficient suction through the workpiece. In some circumstances, mainly when the mask is made of metal, it is possible to keep it in place on the surface to be protected by pressing it down against the surface by mechanical clamping and holding means.

Considerations of cost may also apply in selecting the mask. When cost is important, the preferred mask is made of plastic material, generally polyester, covered with adhesive on one face and metallized on its other face by means of a layer of chromium which provides the desired abrasion resistance. A mask of this type having a thickness of 25 microns is commercially available under the name FASCAL. Such a polyester mask metallized by means of a layer of chromium is entirely suitable for use in the method of the invention. Its edge delimiting the zone being worked by visible-mark brushing can withstand without damage 400 to 500 passes of the abrasive applied with a manual pressure force of several daN.

Visible-mark polishing is performed using any suitable means appropriate for the nature of the material being worked. It is possible to use metal brushes or polishing sheets as sold in commerce and comprising a flexible support of paper, cloth, polyester, etc., having one of its faces covered with an abrasive powder constituted by aluminum oxide, zirconium oxide, a mixture of said two oxides, silicon carbide, emery powder, corundum, diamond, etc. Polishing pads are also commercially available constituted by a block or a sheet of flexible sponge-like material having a layer of alumina or silicon carbide on one of its faces, with an example of a product of this nature being sold under the name "Scotch-brite" and being entirely suitable for implementing the method of the invention.

BRIEF DESCRIPTION OF THE DRAWINGS

The invention is now described in greater detail with reference to the accompanying drawings, in which.

MORE DETAILED DESCRIPTION

Figure 1:
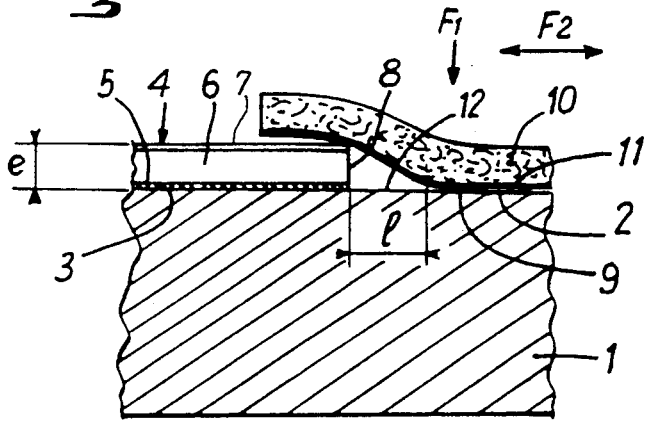
FIG. 1 is a section view on a large scale through a mask which is fixed to a surface being polished by the method of the invention.

FIG. 1 shows a metal plate 1 having a surface 2 on which a decorative pattern is to be made using the method of the invention. In order to protect a zone 3 of the surface which is not to be modified during a given operation, said zone 3 is covered by means of a mask 4 having a total thickness e. This thickness e includes the thickness of a layer of adhesive 5, the thickness of a polyester support 6, and the thickness of a layer of chromium 7. The layer of chromium provides the mask 4 with adequate surface resistance against abrasion. The mask 4 terminates at an edge 8 which delimits a worked zone 9 of the surface 2. The worked zone 9 is polished to leave parallel visible marks by means of a sheet of "Scotch-brite" 10 which is covered on one face with an abrasive layer 11 of aluminum oxide.

The desired appearance is given to the worked zone 9 by pressing the abrasive sheet 10 against the surface 2 as indicated by an arrow F1 and by moving the sheet back and forth alternately in opposite directions as indicated by double-headed arrow F2. These alternating movements may be performed 20 to 30 times, for example. While they are being performed, the abrasive sheet 10 passes over the edge 8 of the mask 4 and is "lifted" onto the mask. The edge 8 and the top face of the mask 4 must withstand the abrasion without being damaged until said alternating movements have been finished. These movements cause parallel scratch marks to appear in the uncovered worked zone 9 of the surface 2.

Because of the thickness of the mask 4, when the abrasive sheet 10 "lifts" itself onto the mask as it goes over the edge 8, the abrasive layer 11 loses contact with the surface 2 prior to reaching the edge 8. As a result, an unworked margin 12 runs along the edge 8 of the mask 4, with the margin retaining the initial appearance of the surface 2. The margin 12 has a width l whose value depends mainly on the thickness of the mask 4 and subsidiarily on the force exerted on the abrasive sheet 10 in the direction of arrow F1.

Figure 2:
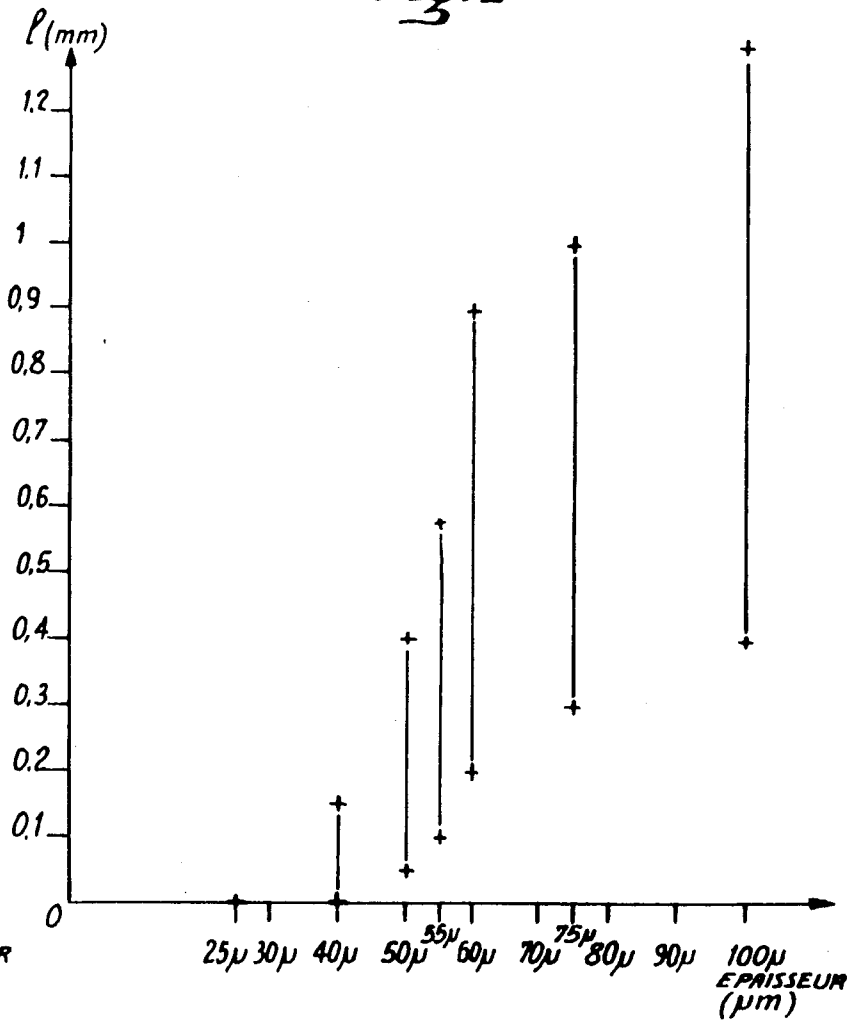
FIG. 2 is a graph showing the effect of mask thickness on the width of the separating margin which appears between two zones polished with visible marks when the force exerted during polishing is less than 1 daN.
Figure 3:
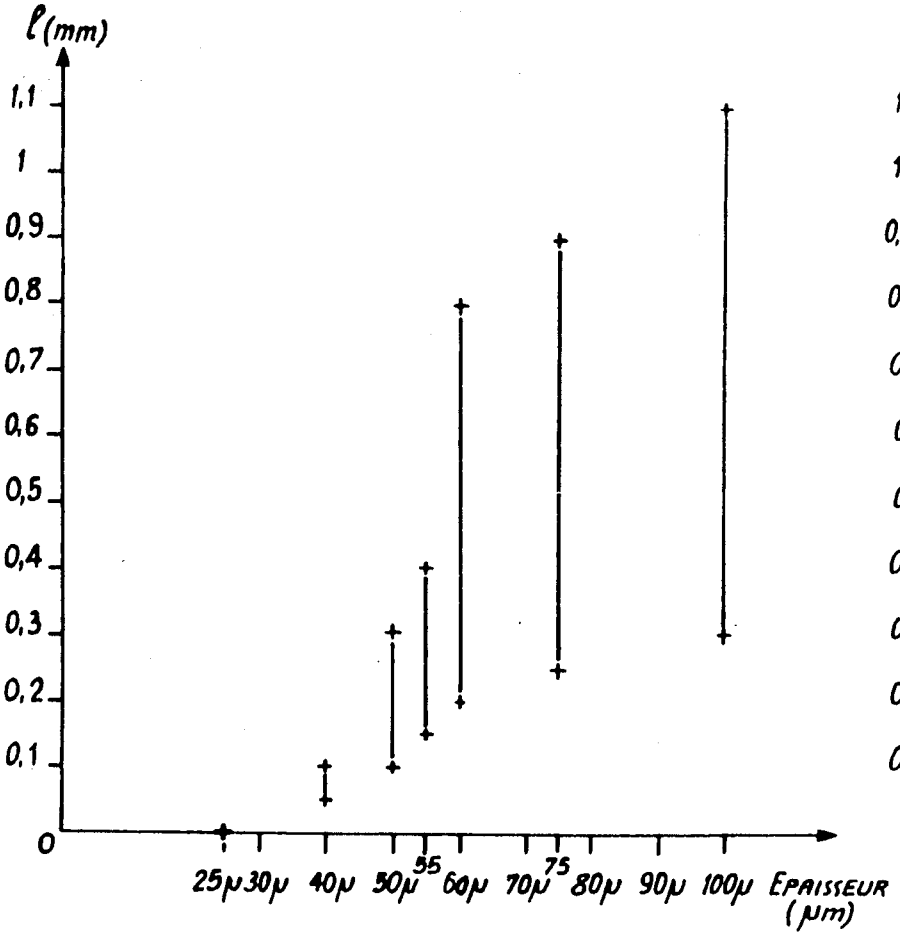
FIG. 3 is a graph analogous to FIG. 2, but for a polishing force lying in the range 3 daN to 4 daN.

The graphs of FIGS. 2 and 3 provide further details on the influence on said width l firstly of the total thickness e of the mask 4 and secondly of the applied force Fl. In these two graphs, the thickness e is plotted in microns along the X axis and the width l is plotted in millimeters up the Y axis.

FIG. 2 relates to the case where the applied force F1 remains less than 1 daN. When using mask thicknesses in the range 25 μm to 40 μm, the width l of the margin 12 is considerably less than 0.1 mm and is not visible to the naked eye. For a mask 4 having a thickness of 40 μm, the margin 12 has a width l of little more than 0.15 mm: it is beginning to be distinguishable by the naked eye but it is still difficult to distinguish, particularly when seen from a distance of a few meters. As the thickness of the mask 4 increases, the width l becomes more and more clearly visible, reaching 0.4 mm at a thickness of 55 μm; 0.9 mm at a thickness of 60 μm; 1 mm at a thickness of 75 μm, and 1.3 mm at a thickness of 100 μm.

The graph of FIG. 3 is analogous to the graph of FIG. 2, but in this case the force applied in the direction F1 onto the abrasive sheet 10 lay in the range 3 daN to 4 daN.

The effect of increasing the force is to reduce the width l of the margin 12. For a thickness of 40 μm, the width l does not exceed 0.1 mm; the following table lists the maximum widths measured:

| thickness e in μm | width l in mm |
|---|---|
| 50 | 0.3 |
| 55 | 0.4 |
| 60 | 0.8 |
| 75 | 0.9 |
| 100 | 1.1 |

In practice, it is observed that the precise points at which the parallel marks are interrupted in the vicinity of the edge 8 of the mask 4 do not lie on a line which is exactly parallel to the edge 8. The value of the width l therefore fluctuates over a range of values as shown in the graphs. It should also be understood that the measurements made are necessarily not precise and that the figures given are more representative of orders of magnitude. Nevertheless, it can clearly be seen from FIGS. 2 and 3 that a mask thickness of 40 μm constitutes a limit beneath which a separating margin between two zones 9 worked in different directions cannot be seen and above which a separating margin begins to show up. Such a separating margin can therefore be avoided altogether or else caused to show up to a greater or lesser extent by suitably chosing the thickness of the mask 4. A thickness which is a multiple of the minimum available thickness can easily be obtained by superposing a plurality of identical masks.

Figure 4:
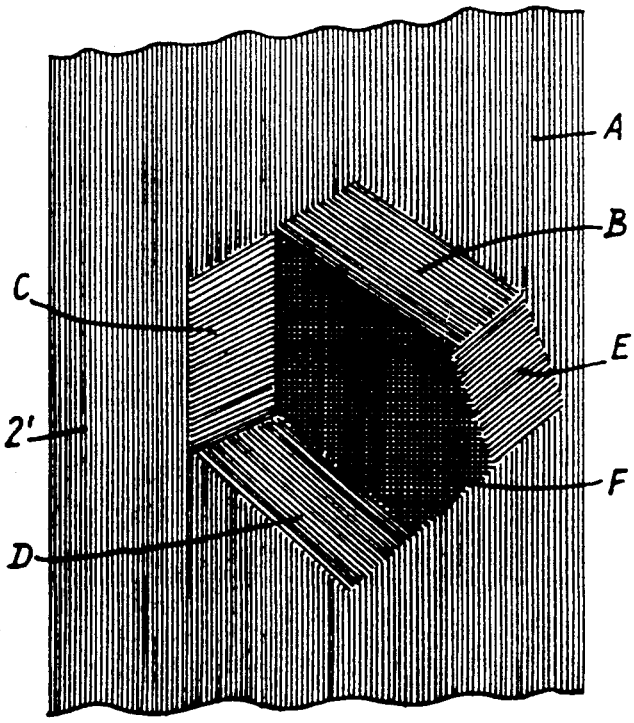
FIG. 4 shows an example of a surface treated in accordance with the method of the invention in order to cause a decorative pattern to appear thereon.
Figure 5:
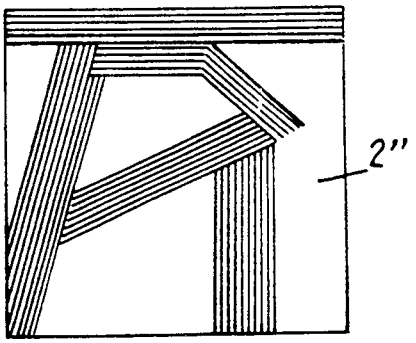
FIGS. 5 and 6 are two addition examples of applications of the method of the invention.
Figure 6:
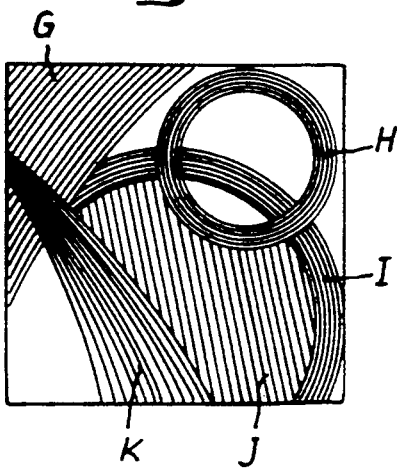

FIGS. 4 to 6 show examples of implementing the method of the invention. In FIG. 4, the surface 2' of a block of material has six zones A, B, C, D, E, and F on which parallel visible marks have been made in different directions for adjacent zones by successive protection using masks 4 having a thickness of 25 μm. No separating margin can be seen between adjacent zones A and E or A and B, e.g. at the ends of the visible marks in said zones. It is possible to provide crosshatched marks as can be seen in area F. FIG. 5 shows that the surface 2" may be left in its initial state which may be a polished state or a matt state, without any visible marks in regions where visible marks have not been deliberately made. FIG. 6 shows that the parallel visible marks are not necessarily rectilinear but that they may be curved as in zones G, H, and I. In addition, the visible marks be they rectilinear or curved are not necessarily parallel. They may be flared as in zone K. This is more difficult to do since it is necessary to use a larger number of masks 4 in succession.

I claim:

1. In a method of polishing a surface to cause adjacent polished zones of arbitrary determined shapes and sizes to appear thereon with visible polished marks extending in at least one general determined direction in each zone, and with adjacent zones having different general directions, the improvement wherein an abrasion-resistant mask is applied against the surface in the zones of said surface other than a zone being polished, said mask having a thickness of not more than 40 μm, and mechanically polishing the unmasked zone to leave visible polish marks made of mechanically produced lines with no precise parallelism and no determined spacing, and wherein the thickness of the mask is such that adjacent polished zones have no discernible separating margin between zones.

2. The method of claim 1 wherein said surface is covered outside a first zone by means of a mask having a thickness of not more than 40 μm, the mask is caused to adhere to the surface, said first zone is polished to cause visible polish marks made of mechanically produced lines with no precise parallelism and no determined spacing and having a first general direction to appear thereon, the mask is removed, said first polished zone and a portion of the surface is then covered with an additional mask to leave a second unmasked zone adjacent to the first zone, said second zone is polished to cause visible polish marks made of mechanically produced lines with no precise parallelism and no determined spacing to appear therein and having a second general direction, said steps are repeated in order to obtain a plurality of polished zones on said surface having visible polish marks made of mechanically produced lines with no precise parallelism and no determined spacing and with different general directions and having no separating margins visible to the eye between adjacent zones.

3. A method according to any one of claims 1 and 2, wherein the mask is caused to adhere to the surface by any of the following means: adhesive; magnetic attraction; suction; and mechanical clamping.

4. A method according to any one of claims 1 and 2, wherein the polishing leaving visible marks in the zones is performed by any of the following means: metal brush; and flexible support having a face coated with an abrasive powder.

5. A method according to any one of claims 1 and 2, characterized in that the mask is constituted by a foil of polyester having one face covered with a layer of adhesive material and having its other face covered with a layer of hard, abrasion-resistant metal, with the total thickness of said foil being 25 μm.

6. A method according to any one of claims 1 and 2, wherein the polishing operation leaving visible marks is performed using a sheet of spongy material having a main face coated with a layer of aluminum oxide abrasive.

* * * * *